US011679306B1

(12) United States Patent
Newcomb

(10) Patent No.: US 11,679,306 B1
(45) **Date of Patent: *Jun. 20, 2023**

(54) ILLUMINATED PICKLEBALL

(71) Applicant: Corky F. Newcomb, Moultonboro, NH (US)

(72) Inventor: Corky F. Newcomb, Moultonboro, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/975,289

(22) Filed: Oct. 27, 2022

Related U.S. Application Data

(63) Continuation of application No. 17/518,218, filed on Nov. 3, 2021, now Pat. No. 11,491,374.

(60) Provisional application No. 63/110,541, filed on Nov. 6, 2020.

(51) Int. Cl.
*A63B 43/06* (2006.01)

(52) U.S. Cl.
CPC ..... *A63B 43/06* (2013.01); *A63B 2225/76* (2020.08)

(58) Field of Classification Search
CPC ..... A63B 43/06; A63B 2225/76; A63B 39/00; A01K 15/025
See application file for complete search history.

(56) References Cited

U.S. PATENT DOCUMENTS 2,020,484 A * 11/1935 Turner ..... A63B 43/06 473/570
3,229,976 A * 1/1966 Allen, Jr. ..... A63B 43/06 362/253
4,479,649 A * 10/1984 Newcomb ..... A63B 43/06 473/570
4,717,158 A * 1/1988 Pennisi ..... A63B 43/06 428/69
4,878,674 A * 11/1989 Newcomb ..... A63B 37/0083 473/200
4,963,117 A * 10/1990 Gualdoni ..... A63B 43/06 473/610

(Continued)

FOREIGN PATENT DOCUMENTS

FR 2846247 A1 * 4/2004 ..... A63B 41/00
FR 2859385 A1 * 3/2005 ..... A63B 43/06

(Continued)

*Primary Examiner* — Steven B Wong
(74) *Attorney, Agent, or Firm* — Quickpatents, LLC; Kevin Prince

(57) ABSTRACT

An illuminated pickleball contains an elongated LED illuminated element with two opposing ends and comprises a shell that includes a plurality of apertures therethrough, two of which being designated as access aperture. The shell includes two opposing element holders which each include a shank projecting inwardly from the inside surface at one of the access apertures and which are mutually longitudinally aligned through a center point of the shell. Each holder is adapted for receiving the elongated illumination element and for retaining one of the opposing ends of the elongated illumination element by friction. When one end of the illumination element is inserted through an access aperture and then through one of the holders to engage the opposing holder, the opposing end of the elongated illumination element is retained, and the illumination element traverses through the center point of the shell and illuminates the pickleball from within.

16 Claims, 4 Drawing Sheets

(56) References Cited

U.S. PATENT DOCUMENTS 5,066,012 A * 11/1991 Stark ..... A63B 43/06 362/369
5,080,359 A * 1/1992 Thill ..... A63B 43/008 446/438
6,059,676 A * 5/2000 Seymour ..... A63B 43/06 473/570
6,575,855 B1 * 6/2003 Buzak ..... A63B 43/06 273/DIG. 8
D478,681 S * 8/2003 Newcomb ..... D26/94
7,261,432 B1 * 8/2007 Habitz ..... A63H 33/22 441/13
7,934,859 B2 * 5/2011 Bryant ..... F21V 33/0036 362/217.1
8,727,919 B1 * 5/2014 Gentile ..... A63B 43/06 473/570
8,992,353 B1 * 3/2015 Kortegast ..... A63B 43/06 362/800
D799,613 S * 10/2017 Dillon ..... D21/713
D800,236 S * 10/2017 Dillon ..... D21/713
11,491,374 B1 * 11/2022 Newcomb ..... A63B 43/06
2003/0199343 A1 * 10/2003 Ilcisin ..... A63B 43/06 473/570
2003/0224885 A1 * 12/2003 Leal ..... A63B 43/06 473/570
2007/0281811 A1 * 12/2007 Wang ..... A63B 43/06 473/570
2010/0035710 A1 * 2/2010 Smith ..... A63B 43/06 473/570
2011/0275463 A1 * 11/2011 Lim ..... A63B 39/00 473/613
2013/0337948 A1 * 12/2013 Smith ..... A63B 43/002 473/570
2017/0065856 A1 * 3/2017 Lin ..... A63B 69/0002

FOREIGN PATENT DOCUMENTS

FR 2859386 A1 * 3/2005 ..... A63B 43/06
FR 2874510 A1 * 3/2006 ..... A63B 43/06

* cited by examiner

ILLUMINATED PICKLEBALL

CROSS-REFERENCE TO RELATED APPLICATIONS

This application is a Continuation of U.S. patent application Ser. No. 17/518,218, filed on Nov. 3, 2021, which itself claimed the benefit of U.S. Provisional Patent Application 63/110,541, filed on Nov. 6, 2020, both being incorporated herein by reference.

STATEMENT REGARDING FEDERALLY SPONSORED RESEARCH AND DEVELOPMENT

Not Applicable.

FIELD OF THE INVENTION

This invention relates to the game of Pickleball, and more particularly to an illuminated pickleball which contains an elongated illumination element.

BACKGROUND

Pickleball is one of the fastest growing racquet sports, and is often played at parks and other locations on tennis courts that have been striped for pickleball play. Not all such courts are lit for night play, and one problem with the game of pickleball is that the pickleball itself can be difficult to see during hours with less than optimal lighting. However, pickleballs that glow in the dark through chemiluminescence due to exposure to UV rays lose their illumination quickly, often well before a single game has been played. Further, inserting an illumination device into the pickleball can easily offset the ball's balance, and therefor hinder gameplay.

Therefore, there is a need for a device that not only keeps the pickleball illuminated for the entire duration of a game or match, but does not offset the balance or weight of the ball. Such a needed device would be relatively inexpensive, and intuitive to use and play with. The present invention accomplishes these objectives.

SUMMARY OF THE INVENTION

The present device is an illuminated pickleball which contains an elongated illuminated element with two opposing ends. The pickleball is comprised of a shell, which has an outside surface and an inside surface. A hollow interior space is defined by the inside surface of the shell. The shell is typically made of a polymer material, but may also be made with any resilient material. The shell further includes a plurality of apertures therethrough, two opposing apertures being designated as access apertures. The shell further includes two opposing element holders which each include a shank projecting inwardly from the inside surface of the shell at one of the access apertures. Both element holders are mutually longitudinally aligned through a center point of the shell.

Each holder is adapted for receiving through one of the access apertures of the shell the elongated illumination element, and for retaining one of the opposing ends of the elongated illumination element by friction. Preferably, each holder includes a friction retention element adapted for retaining one end of the elongated illumination element. When one end of the illumination element is inserted through one of the access apertures of the shell and then through one of the holders to engage the opposing holder, the opposing end of the elongated illumination element is retained by one of the holders, and the illumination element thereby illuminates the pickleball.

The elongated illuminated element preferably includes an LED illumination device, a wireless LED illumination device, or some other lightweight illuminated element that is small enough to traverse through the apertures and is also weight-balanced around a center point thereof that aligns with the center point of the shell. Such an LED illumination device includes at least on LED and a battery to power the LED.

Preferably the access aperture is of a diameter smaller than a diameter of the elongated illumination element, whereby the illumination element is deformed while traversing the access aperture in order to prevent the illumination element from escaping the pickleball during gameplay.

Further, a preferred embodiment includes the shell that is comprised of two halves, where each shell half is fixed with the other shell half with an adhesive, ultrasonic bonding, a screw thread feature, or the like.

The shell halves ideally each have an equatorial rim, the shell formed by fixing the equatorial rims of each shell half together. Each shell half is substantially identical and formed through an injection molding process with a resilient plastic material.

The present invention keeps the pickleball illuminated for the entire duration of the game, but does not offset the balance or weight of the ball. The present invention accomplishes these objectives. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
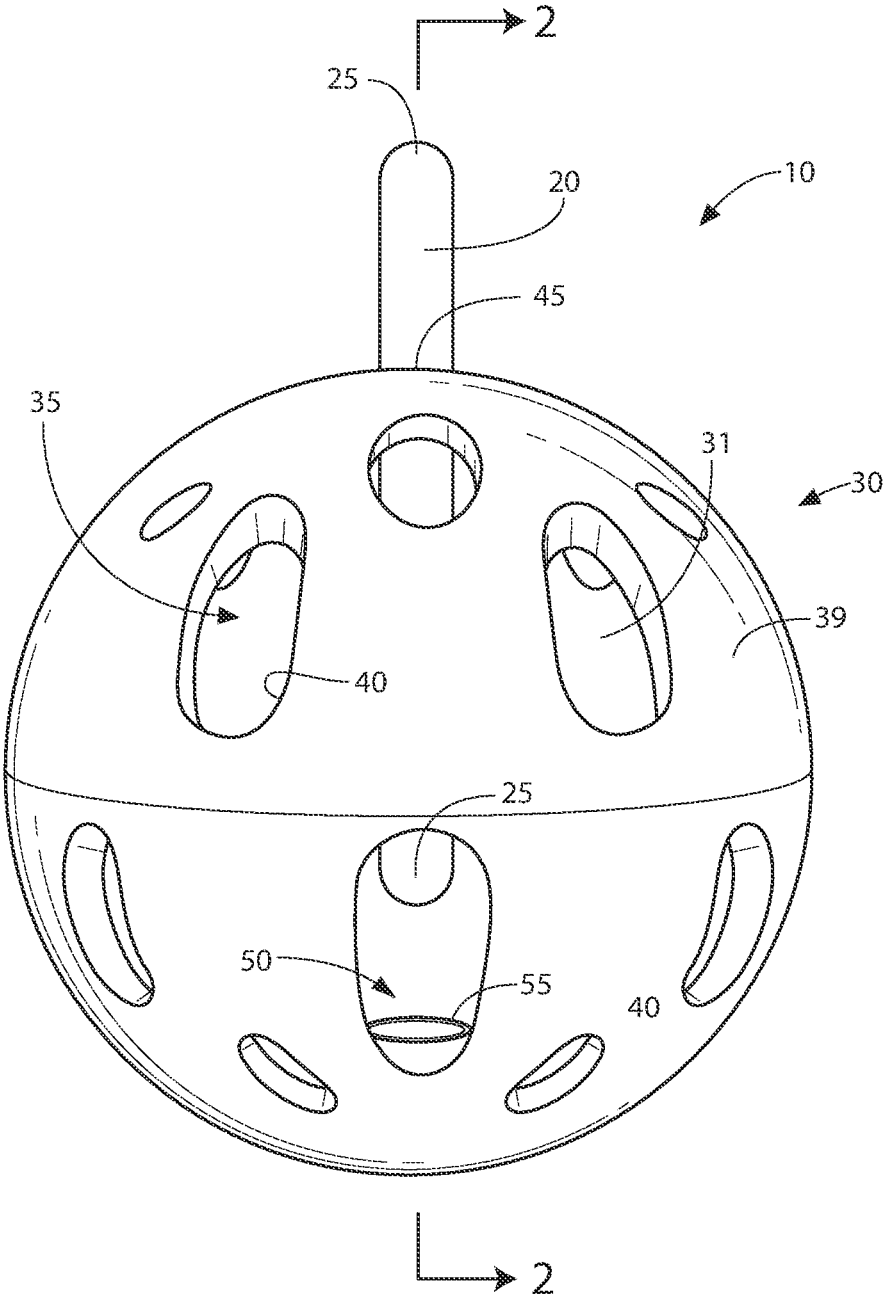
FIG. 1 is a front elevational view of the invention.

The present invention is an illuminated pickleball 10 which contains an elongated illuminated element 20 with two opposing ends 25 (FIG. 1). The pickleball 10 is comprised of a shell 30, which has an outside surface 39 and an inside surface 31, a hollow interior space 35 being defined by the inside surface 31 of the shell 30. The shell 30 is typically made of a polymer material, but may also be made with any resilient material. The material of which the shell 30 is made is ideally made of translucent material, but the material may also be opaque or transparent. Further, the material is preferably made of a type of material that has a relatively low impact sound when contacting a concrete surface.

The shell 30 further includes a plurality of apertures 40 therethrough, two opposing apertures being designated as access apertures 45. The shell 30 further includes two opposing element holders 50 which each include a shank 55 (FIGS. 2 and 3) projecting inwardly from the inside surface 31 at one of the access apertures 45 and which are mutually longitudinally aligned through a center point 60 of the shell. Each holder 50 is adapted for receiving through one of the access apertures 45 of the shell 30 the elongated illumination element 20 and for retaining one of the opposing ends 35 of the elongated illumination element 20 by friction. Preferably, each holder 50 includes a friction retention element 56 adapted for retaining one end of the elongated illumination element 30.

When one end of the illumination element 20 is inserted through one of the access apertures 45 of the shell 30 and then through one of the holders 50, the illumination element 20 engages the opposing holder 50, the opposing end 25 of the elongated illumination element 20 being retained by the opposing holders 50. The illumination element 20 thereby illuminates the pickleball 10 from within. One access aperture 45 may be smaller than the other access aperture 45, such that a pin or small object can be inserted into the smaller access aperture 45 to push the illumination element 20 out through the other access aperture 45.

The elongated illuminated element 20 includes an LED illumination device 80, or some other lightweight illuminated element that is small enough to traverse through the apertures 40 and weight-balanced about a center point thereof which aligns with the center point 60 of the shell 30 when engaged therewith. Such an LED illumination device 80 includes at least on LED 81, a battery 82 to power the LED 81, and optionally a wireless module 83 adapted to receive wireless commands to turn the LED illumination device 80 on or off. In embodiments without the wireless module 83, the LED 81 is powered on when introducing the battery 82 to the LED illumination device 80.

In an alternate embodiment of the invention, the access apertures 45 are adapted to prevent the illumination element 20 from being removed once inserted into the shell 30, rendering the pickleball 10 in such an embodiment good for a single nighttime use, only until the illumination element 20 expires and no longer illuminates. In such an embodiment, only a single access aperture 45 might be included, for example. Such an embodiment may be used thereafter in lit conditions such as in daylight.

Figure 2:
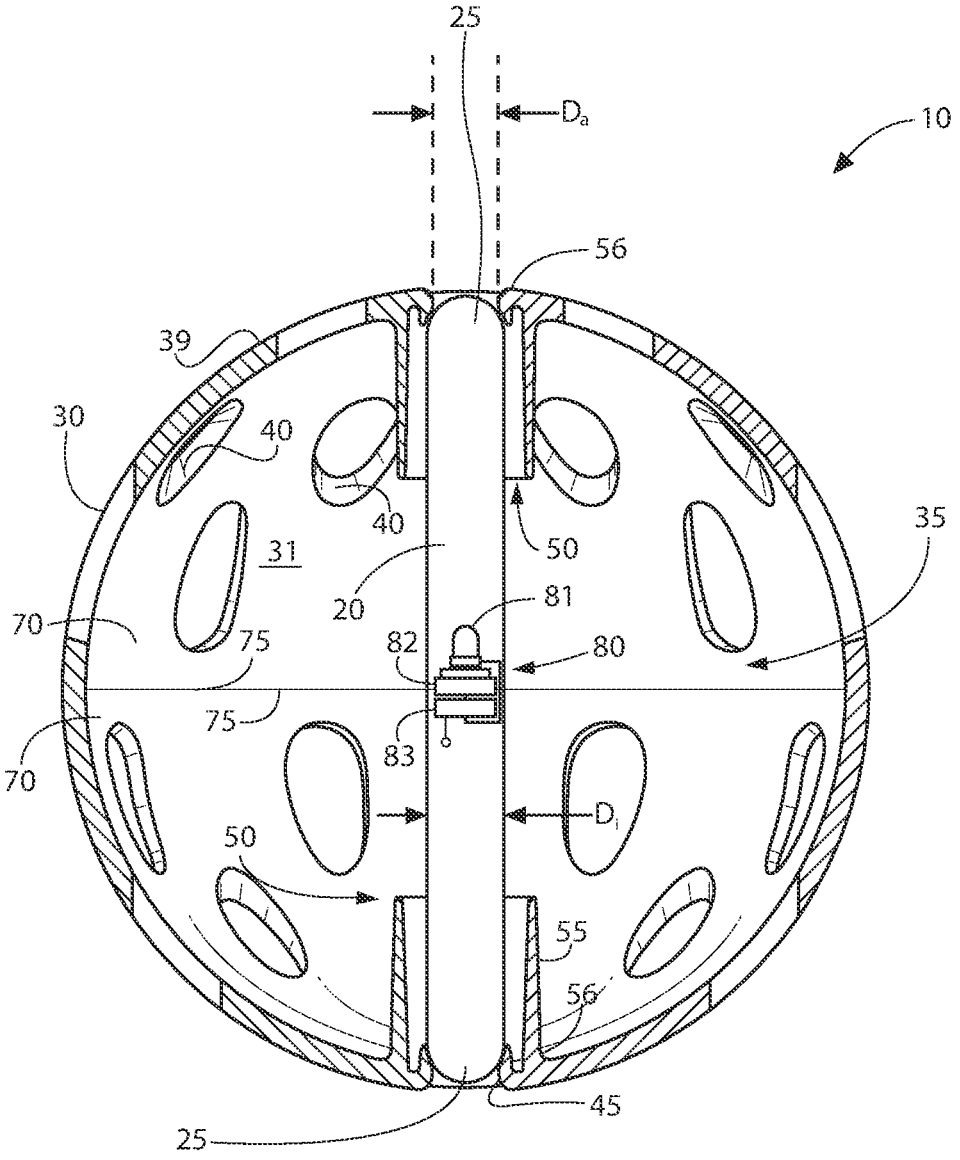
FIG. 2 is a cross-sectional view taken along line 2-2 of FIG. 1.
Figure 3:
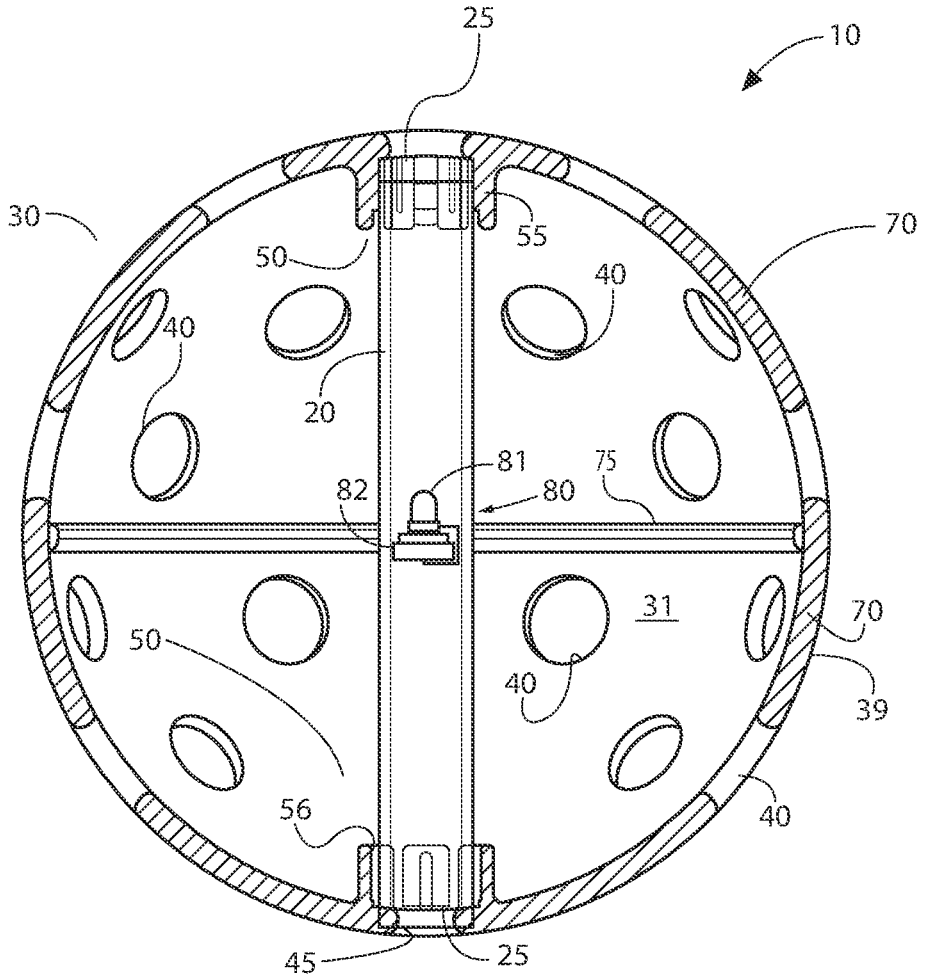
FIG. 3 is a cross-sectional view of a preferred embodiment of the claimed design, taken along line 2-2 of FIG. 1.
Figure 4:
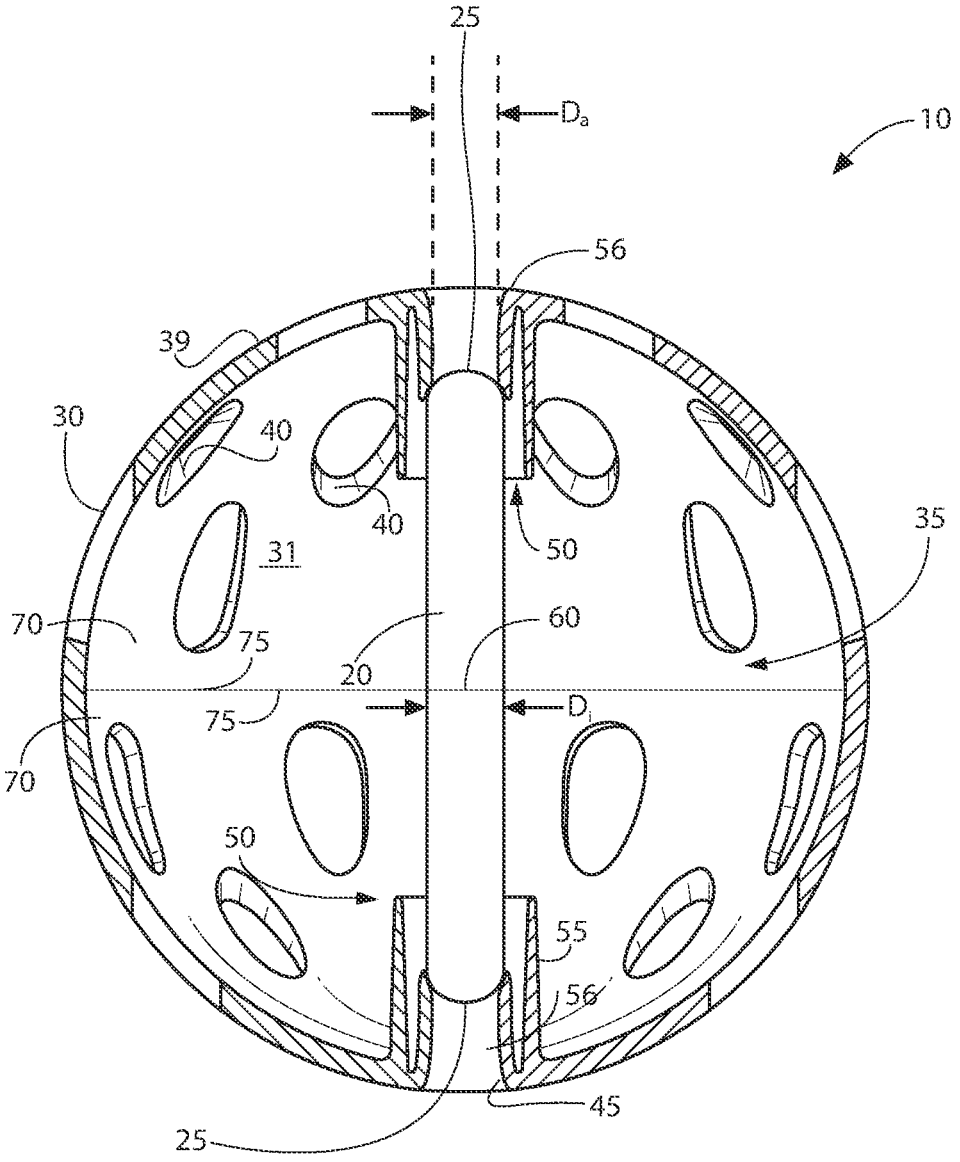
FIG. 4 is a cross-sectional view similar to FIG. 2, but illustrating an embodiment wherein an elongated illuminated element is relatively short and held away from an outside surface of a pickleball shell.

Preferably the access aperture is of a diameter DA smaller than a diameter of the elongated illumination element Di, whereby the illumination element 45 is deformed while traversing the access aperture in order to prevent the illumination element 45 from escaping the pickleball 10 during gameplay (FIGS. 2 and 4).

Further, in a preferred embodiment the shell 30 is comprised of two shell halves 70, where each shell half 70 if fixed with the other shell half 70 with an adhesive, ultrasonic bonding, a screw thread feature (FIG. 3), or the like. The shell halves 70 ideally each have an equatorial rim 75, the shell 30 formed by fixing the equatorial rims 75 of each shell half 70 together. Each shell half 70 is substantially identical and preferably formed through an injection molding process with a resilient plastic material. Preferably the pickleball 10 conforms to specifications required by the U.S.A. Pickleball Association, namely that a diameter of the pickleball 10 is between 7.29 cm and 7.54 cm, weights between 22.1 g and 26.5 g, will bounce up to between 30 inches and 34 inches when dropped from 198.1 cm on a granite stone surface plate 12"×12"×4" at an angle of 75 to 80-degrees, has a durometer of 40 to 50 on the D scale at 75 to 80 degrees, and has 26 to 40 of the apertures 40.

In an alternate embodiment of the invention, illustrated in FIG. 4, the illuminated element 20 is relatively short so that the opposing ends 25 thereof are held within the shell 30 away from the outside surface 39 thereof. As such, when the pickleball 10 contacts the concrete surface at one of the access apertures 45, the pickleball 10 bounces in a similar manner to when the pickleball 10 contacts the concrete surface on the outside surface 39 of the shell 30 away from either of the access apertures 45. In this manner the illuminated element 20 in such an embodiment does not directly impact bounce characteristics of the pickleball 10.

While a particular form of the invention has been illustrated and described, it will be apparent that various modifications can be made without departing from the spirit and scope of the invention. For example, the elongated illumination element 30 does not have to be secured to the holders by friction. Adhesive, a screw thread securing mechanism, an openable doorway arrangement, or the like can also be used. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms.

Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An illuminated pickleball for use with an elongated illumination element having two opposing ends, the pickleball comprising:

a shell having an outside surface and an inside surface, a hollow interior space being defined by the inside surface of the shell, the shell including a plurality of apertures therethrough, two opposing of the apertures being designated as access apertures; and two opposing element holders each including a shank projecting partially inwardly from the inside surface at one of the access apertures and mutually longitudinally aligned through a center point of the shell, each holder adapted for receiving through one of the access apertures of the shell the elongated illumination element and for retaining one of the opposing ends of the elongated illumination element by friction;

wherein one of the access apertures has a first opening smaller than a second opening of an opposing one of the access apertures;

whereby one end of the illumination element is inserted through one of the access apertures of the shell and then through one of the holders to engage the opposing holder, the opposing end of the elongated illumination element retained by the one of the holders, the illumination element thereby illuminating the pickleball, wherein a central portion of the elongated illumination element is free from any structure between the elongated illumination element and an inside surface of the shell; and wherein the illumination element includes an LED illumination device that includes at least one LED.

2. The pickleball of claim 1 wherein each holder includes a friction retention element adapted for retaining one end of the elongated illumination element by friction.

3. The pickleball of claim 1 wherein each access aperture is of a diameter smaller than a diameter of the elongated illumination element, whereby the illumination element is deformed while traversing the access aperture.

4. The pickleball of claim 1 wherein the shell is comprised of two shell halves each having an equatorial rim, the shell formed by fixing the equatorial rims of each shell half together, each shell half being substantially identical.

5. The pickleball of claim 4 wherein each shell half is fixed with the other shell half with an adhesive.

6. The pickleball of claim 4 wherein each shell half is fixed with the other shell half with ultrasonic bonding.

7. The pickleball of claim 4 wherein each shell half is formed through an injection molding process with a plastic material.

8. The pickleball of claim 1 wherein each holder is adapted to retain the elongated illumination element centered within the hollow interior space of the shell and with the opposing ends of the elongated illumination element held away from the outer surface of the shell and within an inner surface of the shell.

9. An illuminated pickleball comprising:

a shell having an outside surface and an inside surface, a hollow interior space being defined by the inside surface of the shell, the shell including a plurality of apertures therethrough, two opposing of the apertures being designated as access apertures;

an elongated illumination element having two opposing ends; and two opposing element holders each including a shank projecting partially inwardly from the inside surface at one of the access apertures and mutually longitudinally aligned through a center point of the shell, each holder adapted for receiving through one of the access apertures of the shell the elongated illumination element and for retaining one of the opposing ends of the elongated illumination element by friction;

wherein one of the access apertures has a first opening smaller than a second opening of an opposing one of the access apertures;

whereby one end of the illumination element is inserted through one of the access apertures of the shell and then through one of the holders to engage the opposing holder, the opposing end of the elongated illumination element retained by the one of the holders, the illumination element thereby illuminating the pickleball, wherein a central portion of the elongated illumination element is free from any structure between the elongated illumination element and an inside surface of the shell; and wherein the illumination element includes an LED illumination device that includes at least one LED.

10. The pickleball of claim 9 wherein each holder includes a friction retention element adapted for retaining one end of the elongated illumination element by friction.

11. The pickleball of claim 9 wherein each access aperture is of a diameter smaller than a diameter of the elongated illumination element, whereby the illumination element is deformed while traversing the access aperture.

12. The pickleball of claim 9 wherein the shell is comprised of two shell halves each having an equatorial rim, the shell formed by fixing the equatorial rims of each shell half together, each shell half being substantially identical.

13. The pickleball of claim 12 wherein each shell half is fixed with the other shell half with an adhesive.

14. The pickleball of claim 12 wherein each shell half is fixed with the other shell half with ultrasonic bonding.

15. The pickleball of claim 12 wherein each shell half is formed through an injection molding process with a plastic material.

16. The pickleball of claim 9 wherein each holder is adapted to retain the elongated illumination element centered within the hollow interior space of the shell and with the opposing ends of the elongated illumination element held away from the outer surface of the shell.

* * * * *